United States Patent [19]

Levy

[11] Patent Number: 4,975,999

[45] Date of Patent: Dec. 11, 1990

[54] KEYBOARD CLEANER

[75] Inventor: Edward H. Levy, Brooklyn, N.Y.

[73] Assignee: EHL Development Inc., Brooklyn, N.Y.

[21] Appl. No.: 374,089

[22] Filed: Jun. 30, 1989

Related U.S. Application Data

[62] Division of Ser. No. 173,270, Mar. 25, 1989, Pat. No. 4,864,677.

[51] Int. Cl.[5] ..... A47L 25/00

[52] U.S. Cl. ..... 15/210 R; 15/118; 15/244.1

[58] Field of Search ..... 15/210 A, 210 R, 244.1, 15/244.3, 105, 244.4; 401/7, 9, 37–39, 22, 23, 195, 196, 204–206; 34/95.1, 95.4

[56] References Cited

U.S. PATENT DOCUMENTS

| | | | |
|---|---|---|---|
| 1,595,950 | 8/1926 | Kirsner | 15/210 R |
| 1,635,127 | 7/1927 | Kirsner | 15/210 R |
| 1,692,384 | 11/1928 | Partell | 34/95.4 |
| 2,147,310 | 2/1939 | Morrison | 15/210 R |
| 2,870,471 | 1/1959 | Albert | 15/244.1 |
| 3,137,880 | 6/1964 | Kubit et al. | 15/210 R |
| 3,164,853 | 1/1965 | Peeler | 15/244.1 |
| 3,402,417 | 9/1968 | Lund | 15/244.1 |
| 4,183,684 | 1/1980 | Avery, Jr. | 401/196 |
| 4,252,454 | 2/1981 | Brenner | 15/210 R X |
| 4,628,564 | 12/1986 | Youssef | 15/244.1 |

FOREIGN PATENT DOCUMENTS

| | | | |
|---|---|---|---|
| 2153109 | 5/1973 | Fed. Rep. of Germany | 15/244.1 |

OTHER PUBLICATIONS

INMAC catalog pp. 34, 115, 116, 118 (Nov. 1987).

*Primary Examiner*—Edward L. Roberts
*Attorney, Agent, or Firm*—Henry D. Coleman; R. Neil Sudol

[57] ABSTRACT

This invention relates to a keyboard cleaning device. More particularly, this invention relates to a device for cleaning upper and/or lateral surfaces of keyboard buttons or keys. In a first embodiment of the present invention, a key cleaner is comprised of a head structure having at least one convex cleaning substructure contoured to the top surface of a key of a data entry keyboard, a handle and means for attaching the handle to the head structure. Pursuant to a second embodiment of the present invention, the key cleaner is comprised of a head structure having at least one wedge-shaped cleaning substructure which is contoured to fit between the keys of a data entry keyboard and a handle attached to the head structure. Other embodiments are also described.

15 Claims, 4 Drawing Sheets

KEYBOARD CLEANER

This is a division of application Ser. No. 173,270 filed Mar. 25, 1988 now U.S. Pat. No. 4,864,677.

BACKGROUND OF THE INVENTION

This invention relates to a keyboard cleaning device. More particularly, this invention relates to a device for cleaning upper and/or lateral surfaces of keyboard buttons or keys including keys on computer, typewriter, machine-operator console and cash register keyboards.

Computing and word processing systems have made data entry keyboards ubiquitous in the private sector, government and home. Data entry keyboards are now commonly used by data-entry personnel, secretaries, receptionists, programmers, clerks, computer-controlled machine operators, and others. Data entry keyboards are now even used on many cash registers. Use of these keyboards will grow as the role played by computers in modern society increases.

To input data into a computer, cash register or other device, the user touches the keys of a data-entry keyboard with the fingertips. Through frequent contact, the upper key surfaces tend to accumulate a coating of grease. This provides a favorable medium for collecting dirt and dust within the work area. The dirt and dust also accumulates on the side surfaces of the keys over time. This accumulation may be exacerbated by a number of users having access to a keyboard or any one user eating or drinking in the vicinity of the keyboard.

Dirt on the keys of a keyboard gives an unpleasant appearance and feeling which can have a negative effect on the productivity and satisfaction of the keyboard user. Accumulation of dirt, grease, food or soda can actually make the keys stick, causing an increased chance of data-entry error. On data-entry keyboards associated with cash registers, caked on grease and dirt are especially problematic.

Presently, there is no commonly available tool or easy method to facilitate the cleaning of keyboards. Present methods of cleaning keyboards are awkward, tedious and ineffective. Keyboard users allow dirt to accumulate on the keys to the point such dirt negatively impacts productivity and increases the potential for damage to the internal workings of the keyboard.

The most common current method of cleaning the keys is to rub the upper surface of the keys with tissue paper sprayed with an office furniture cleaner. This method is clumsy and crude, even for the upper key surfaces. The lateral key surfaces are very difficult to reach using this method.

Recently, cotton swab-like devices have become available in professional cleaning kits, or through computer supply distributors. These devices may be used to clean the upper key surfaces, but are not much better than tissue paper. In addition, these devices are inadequate for cleaning the lateral surfaces of the keys.

Other approaches to cleaning keys involve blowing the keys with compressed air or exposing the keys to suction with a miniaturized vacuum. These approaches are not effective because most of the dirt that accumulates sticks to the keys. The dirt is not susceptible to low-level air pressure or suction.

It is, therefore, a principal object of the present invention to provide a simple device and a method for inexpensively, rapidly and effectively cleaning the keyboards of data entry equipment. An additional, more particular object of the present invention is to provide such a device for effectively cleaning both the top and lateral surfaces of keys of data-entry keyboards.

It is an additional object of the present invention to provide a device for cleaning more than one key on a data-entry keyboard at the same time. It is a further object of the present invention to provide a device that can both clean data entry keyboards and dry them off after an initial cleaning step is performed. It is a further object of the present invention to provide a method for cleaning and drying the keys of data entry keyboards.

These and other objects of the present invention will be understood from a consideration of the specification and the drawings which are attached hereto.

SUMMARY OF THE INVENTION

In a first embodiment of the present invention, a key cleaner is comprised of a head structure having at least one convex cleaning substructure contoured to the top surface of a key of a data entry keyboard, a handle and means for attaching the handle to the head structure.

Pursuant to a second embodiment of the present invention, the key cleaner is comprised of a head structure having at least one wedge-shaped cleaning substructure which is contoured to fit between the keys of a data entry keyboard and a handle attached to the head structure.

Pursuant to a third embodiment present invention, the key cleaner comprises a head structure having at least one convex cleaning substructure contoured to the top surface of a key of a data entry keyboard, and at least one wedge-shaped cleaning substructure which is contoured to the lateral surfaces of the keys of the keyboard, and optionally, a handle and means for attaching the handle to the head structure. It is also contemplated that the head structure having a convex cleaning substructure alone or in combination with a wedge-shaped cleaning substructure may include a concave-shaped cleaning substructure contoured to the convex surface of, for example, a space bar key.

Pursuant to a fourth embodiment of the present invention, the head structure of the key cleaner is comprised of a plurality of convex or wedge-shaped cleaning substructures, each cleaning substructure extending outwardly away from the body of the head structure along a single row. In other embodiments, it is contemplated that alternating cleaning substructures may be adapted for washing/scouring or wiping/drying the keys.

Pursuant to a fifth embodiment of the present invention, a key cleaner has at least two rows, one row having convex cleaning substructures and one row having wedge-shaped cleaning substructures. An additional embodiment is contemplated having at least one row of cleaning substructures alternately contoured to the top and lateral surfaces of a data-entry keyboard key.

The handles of each of the embodiments of the present invention may be adapted to deliver a cleaning liquid to the surface of the cleaning substructure of the present invention.

In the embodiments of the present invention, each cleaning substructure may be operatively connected to a means for vibrating or moving the cleaning substructure.

In additional embodiments of the present invention, each cleaning substructure may be provided with holes and adapted to fit onto a vacuum cleaner.

DETAILED DESCRIPTION OF THE INVENTION

Figure 1A:
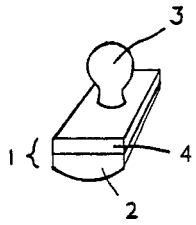
FIGS. 1A, 1B and 1C are perspective views of key cleaners of the present invention having a convex cleaning substructure.

Referring to FIG. 1, a key cleaner comprises a head structure 1 having at least one convex cleaning substructure 2 contoured to the top surface of a key on a data entry keyboard and further comprises a rigid handle 3. Cleaning substructure 2 is attached to handle 3 by a flat support structure 4 one side of which is attached to handle 3 and an opposite side of which is attached cleaning substructure 2. It is also possible to attach handle 3 directly to cleaning substructure 2, thus avoiding the need for flat support structure 4.

Cleaning substructure 2 may be soft, semi-rigid or rigid, and is preferably rigidly secured to the head structure or directly to the handle, and is preferably removable for purposes of replacement. In certain embodiments of the present invention, the cleaning substructure is preferably made of or covered by an abrasive material, e.g., a material comprised of filaments which are compressed into a surface having a rough texture. An abrasive material, for purposes of the present invention, is a material which provides an effective means of cleaning hard-to-remove grease and other dirt. The action associated with an abrasive material will hereinafter be referred to as a wash or scour action.

When the cleaning substructure of the present invention is designed to be used to wash or scour the keys, the cleaning substructure is preferably semi-rigid, i.e., rigid enough to avoid losing its basic shape when ample pressure is placed on the structure to remove caked-on grease, dirt and food, but not so rigid as to prevent adequate cleaning surface from coming into contact with the surface of the keys. When the cleaning substructure is too soft, for example, when it is made out of a soft sponge material, it may be incapable of performing a scouring action.

The cleaning substructure adapted for washing or scouring is preferably comprised of an abrasive material for effectively cleaning grease, food and dirt off the keys. It is contemplated that the cleaning substructure may be integrally formed from an abrasive material, or may comprise an underlying structure made of plastic or similar rigid material and wrapped or surrounded by an abrasive material. In embodiments utilizing an abrasive material surrounding an underlying plastic support, it is contemplated that the abrasive material, after use, may be replaced by another piece of abrasive material and discarded.

In embodiments having a structure designed to clean dirt which is easily removed or to dry the surface of the keys after a first wash or scour step, that structure may be less rigid and/or absorbent. The action associated with this second cleaning step will hereinafter be referred to as wiping or drying action. When the cleaning substructure is provided primarily for drying the surfaces of the keys, for example, after a first washing or scouring step, the substructure preferably comprises an absorbent material. The absorbent material is preferably soft, and typically may be comprised of pressed paper products, or sponge-like materials. It is contemplated that a first washing/scouring step may be used in combination with a second wiping/drying step. Because almost all of the dirt will have been loosened during the washing/scouring step, it is contemplated that the substructure used for wiping/drying will primarily be used to remove any residual water, cleaning liquid or loose dirt that remains on the keys after washing/scouring.

Figure 3A:
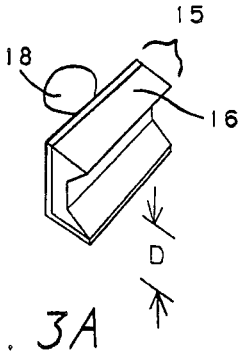
FIGS. 3A and 3B are a perspective view showing a key cleaner having a concave-shaped cleaning substructure.
Figure 3B:
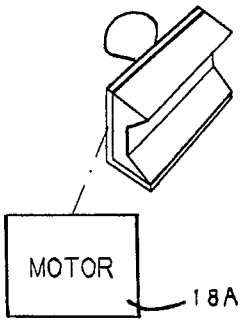

In certain embodiments of the present invention, the cleaning substructure may be operatively connected to a device for vibrating or moving the cleaning substructure as pictured in FIG. 3B. Such a device preferably includes a battery-operated electric motor. The movement of the cleaning substructure is preferably a rapid, reciprocating motion, similar to that produced by an electric toothbrush. Also contemplated is a vibrational motion similar to that produced by sonicators. The devices for vibrating or moving the cleaning substructure are readily available in the art, and in the case of each of the different embodiments contemplated by the present invention, the cleaning substructures and head structures may be easily modified using structures and methods available in the prior art to operatively connect the cleaning substructure to the vibrating or moving devices.

In certain additional embodiments, the cleaning substructure of the present invention may be provided with holes and adapted to fit onto a vacuum cleaner. With this cleaning substructure, the user may use the cleaning substructure to loosen dust or other easy-to-remove dirt on the top and/or lateral surfaces of the keys and use the vacuum cleaner to remove the loosened dust or dirt.

Figure 2A:
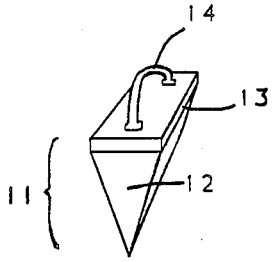
FIGS. 2A and 2B are perspective views showing key cleaners having a wedge-shaped cleaning substructure.

The handle of the present invention may conform to any number of configurations well known in the art suitable for gripping by the hand. The handle may therefore, be bulb-like as pictured in FIGS. 1A, B and C, elongated and rounded as shown in FIG. 2A, or rod-like, elongated and attached at an angle to the head structure. The handle may even comprise the same material used for the head structure or the cleaning substructure. In addition, the handle may simply comprise indentations in or ridges on the head structure which are suitable for gripping the key cleaner. In embodiments of the key cleaner wherein only one side of the head structure has cleaning substructures, it is preferred that the handle is rigidly attached to the head structure on a side opposite the cleaning substructure.

The present invention contemplates an easy replacement of the cleaning substructures. As illustrated in FIG. 1 B, a key cleaner comprises a cleaning substructure 5, a flat support 6, and an element for attaching the cleaning substructure to the flat support comprising a screw 7 and including a threaded bore 8 running through the flat support and a handle 9 integral with the flat support. Alternatively, the cleaning substructure may be securely fastened directly to allow scrubbing or scouring of the keys but easy replacement.

Figure 1B:
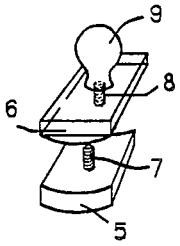

The cleaning substructure may be attached to the flat support of the head structure or to the handle exemplarily by a latch, fasteners, or a screw as shown in FIG. 1 B. Accordingly, the cleaning substructure may have a threadable projection screwable into a bore in the flat support structure as shown in FIG. 1B or the handle, or alternatively, the cleaning substructure may have a bore into which is screwed the flat support structure or the handle having a threadable projection. The projection may also run through the bore in the flat support into the handle. The handle may also be pivotally attached to the head structure using means which are readily available in the art, but such attachment is less preferred. In embodiments of the present invention wherein the handle is an extension of the head structure or cleaning substructure, there is no need for separate fastening elements.

The handle may be made of any material compatible with gripping. Preferably the material should be rigid. Plastic is a preferred material because of its ease of manufacture, its light weight and relative strength.

Figure 1C:
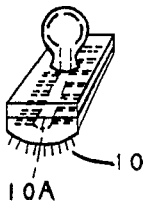

Another preferred embodiment of the present invention provides a cleaning substructure with an absorbent material having short, brush-like protrusions 10 emanating therefrom as depicted in FIG. 1C which function to scrub dirt or food from the key structure. The protrusions should not change the cleaning substructure's overall shape, nor will they prevent the absorbent material from coming into contact with the key surface. The absorbent material preferably conducts cleaning fluid to its surface and on to the surface of the protrusions.

It is also possible to construct a cleaner having a cleaning substructure combining a washing or scouring action with a wiping or drying action. This would enable one cleaning structure to perform both types of action.

As depicted in FIGS. 1A, B, and C, in a first embodiment of the present invention, the cleaning substructure is convex. Advantageous convex cleaning substructures include spherical sections, but in preferred embodiments the convex section is structure is a cylindrical section rounded at one end. Any size which provides an adequate structure to clean the top surface of the keys may be useful, but the most common substructure is no larger than the top surface of the alphanumeric keys of the keyboard.

In many instances it is desirable to have a cleaning liquid delivered to the site of cleaning. This may be done by delivering cleaning liquid to the surface of the keys through a source unconnected with the key cleaner of the present invention. This method however is inefficient and makes it difficult to deliver cleaning liquid only to certain keys of the keyboard. A solution to this problem is to deliver the cleaning liquid to the surface of the cleaning substructure via a storage unit on the key cleaner itself. The cleaning liquid storage unit may take the form of a hollow, compressible storage unit, for example, a handle (see FIG. 1C) which is operatively connected to a conduit 10A which runs from the storage unit through the cleaning substructure. The conduit delivers cleaning liquid from the storage unit or handle to the distal end of the head structure onto the cleaning surface. The conduit may have small holes through which cleaning liquid may flow through the cleaning substructure structure onto its surface. In certain embodiments, the handle is hollow and stores cleaning fluid to be delivered to the cleaning substructure. In these embodiments, it is preferable that the handle should be rigid, yet compressible. In this context, a compressible handle is a handle which, when compressed, will deliver a liquid from the handle through the conduit onto the surface of the substructure without collapsing under pressure adequate to provide a washing or scouring action. To deliver liquid to the surface of the cleaning substructure, the user simply applies pressure to the handle.

The storage unit may be refilled and will preferably include two capped vents through which liquid may easily pass. During refilling, one of the vents will serve as a port through which liquid will be poured and the other vent will function to allow air, which is being replaced by liquid in the storage area, to escape from the storage area.

An alternative to the hollow, compressible handle is to have a separate storage area above the head structure adjacent to the handle from which cleaning liquid is delivered to the surface of the cleaning substructure by way of a conduit. It is also possible to have a means for delivering cleaning liquid, e.g. a squirt mechanism functionally related to the storage area such that cleaning liquid may be forced or sprayed onto the key surfaces or cleaning substructure surfaces from the storage area.

Referring to FIG. 2A, another aspect of the key cleaner of the present invention comprises a head structure 11 having at least one wedge-shaped cleaning substructure 12 adapted to fit between the keys of a data-entry keyboard. As in the first convex cleaning substructure embodiment, it is contemplated that the head structure preferably comprises a cleaning substructure and a flat support structure 13 for the cleaning substructure. A handle 14 is attached to the head structure preferably integrally with the flat support structure, and the cleaning substructure preferably is rigidly, yet removably attached to the flat support. The handle may incorporate any of the features described hereinabove, but it is preferably made of plastic and is integral with the flat support structure on a side opposite the cleaning substructure. The handle may be attached directly to the cleaning substructure to allow the cleaning substructure to be rigidly secured for washing or scouring the keys, but also to allow easy replacement of the substructure. Attaching the cleaning head to the flat support or handle may be accomplished by using a screwable projectile to screw the handle into the cleaning substructure or to screw the cleaning substructure into the handle. An alternative is to use latch means or other fasteners to secure the cleaning substructure onto the handle. In certain embodiments of the present invention having a handle comprised of excess material from the cleaning substructure, there is no requirement for any means for attachment because the handle will be integral with the cleaning surface material. In embodiments designed to deliver liquid to the surface of the cleaning substructure, the key cleaner may incorporate the same features for delivering cleaning liquid to the surface of the cleaning substructure described hereinabove.

Of course, it is also possible to provide a cleaning substructure comprising a half-wedge which may be used for cleaning one lateral side of a key instead of the preferred full wedge which may be used for cleaning at the same time the lateral surfaces on two adjacent keys.

The wedge-shaped cleaning substructure is preferably made of or covered with an abrasive material for purposes of cleaning or scouring the surface of the keys. Preferred embodiments utilize an abrasive material or alternatively, a cleaning substructure comprised of an absorbent material out of which emanate brush-like protrusions for washing or scouring the key surfaces. In certain embodiments comprising a means for delivering cleaning fluid, the absorbent material preferably conducts cleaning liquid from the conduit within the cleaning substructure to its surface. In embodiments of the present invention designed primarily for wiping or drying the surface of the keys, it is preferred that an absorbent material should be used. It may be possible to combine the dual functions of cleaning and drying the surfaces of the keys in one cleaning substructure by providing an abrasive material that is also absorbent or by providing the cleaning substructure with an underlying absorbent material having semi-rigid brush-like protrusions emanating from the cleaning substructure. The brush-like protrusions are contemplated to aid in washing or scouring the keys and the absorbent material to dry residual cleaning liquid off of the surfaces of the keys.

It is also possible to combine abrasive and absorbent surfaces on one full wedge-shaped cleaning substructure by providing one of the two lateral cleaning surfaces of the wedge with an abrasive material for washing or scouring and the other lateral cleaning surface with an absorbent material for wiping or drying the keys. A further modification of this embodiment may include a lateral surface having brush-like protrusions emanating from an absorbent material, and additionally, means for delivering cleaning fluid to this surface. The other lateral surface, preferably comprised of an absorbent material, may function as a drying surface.

Figure 2B:
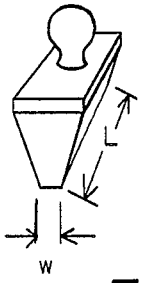
Figure 2C:
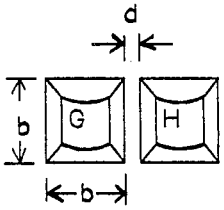
FIG. 2C is a top view of two adjacent keys on a computer keyboard.

In a preferred embodiment of the key cleaner having a wedge-shaped cleaning substructure, in order that the cleaning substructure may fit between two keys, it is contemplated that the length of the wedge-shaped cleaning substructure will be no greater than the length of one side of the base of the alphanumeric keys on the keyboard. Referring to FIG. 2B, length L is the length of the wedge-shaped cleaning substructure. Referring to FIG. 2C, b represents the length of one side of the base of an alphanumeric key. By limiting the length L of the cleaning substructure, it is contemplated that the key cleaner may be easily used to clean areas between keys wherein the key rows are staggered.

In a second embodiment having a wedge-shaped cleaning substructure, it is contemplated that L, the length of a wedgeshaped cleaning substructure may be any length, but preferably, is no longer than an entire row of keys. Such an embodiment may be used to clean side surfaces of keys along an entire row.

It is preferred that the width w (FIG. 2B) of the tapered end of most wedge-shaped embodiments should be less than the distance d (FIG. 2C) between the bases of any two keys, which on many keyboards is about 1/32 of an inch. By providing a cleaning substructure with a narrow edge, it is possible to clean the entire surface of the keys including the bottom edges which are especially difficult to reach.

Referring to FIG. 3A, another embodiment of the key cleaner comprises a head structure 15 having at least one concave-shaped cleaning substructure 16 contoured to the top surface of a convex key on a data entry keyboard and optionally, a handle 17. In preferred embodiments, it is contemplated that the concave-shaped cleaning substructure will be used to clean the space bar of a data-entry keyboard. The cleaning substructure will most preferably be about the same width as the base of a space bar, indicated as distance D in FIG. 3A. On most computer keyboards this distance is about ½ inch. The cleaning substructure may be any length, but is preferably no longer than the space bar, i.e., about 3½ to 7 inches on most standard keyboards. The cleaning substructure may be soft, semi-rigid or rigid as in the case of the convex and wedge-shaped embodiments. The cleaning substructure is preferably abrasive and semi-rigid when used for washing or scouring and is preferably absorbent and sponge-like when the structure is used for wiping or drying.

The handle may be integral with the cleaning substructure or a support structure 18 to which is attached the cleaning substructure. The handle may also be attached to the cleaning substructure using any means for attaching available in the art, e.g. glue, screw means, fasteners, etc, but in preferred embodiments, the cleaning substructure is removable so that a replacement cleaning substructure may be positioned to take the place of the used or worn cleaning substructure. The handle may also be pivotally attached to the cleaning substructure or to the support structure. As illustrated in FIG. 3B, the cleaning substructure may be operatively connected to a motor 18A which provides a vibrational or reciprocating motion to the cleaning substructure.

Figure 4A:
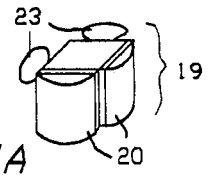
FIGS. 4A and 4B are perspective views showing key cleaners having, respectively, two convex-shaped cleaning substructures and two wedge-shaped cleaning substructures.
Figure 4B:
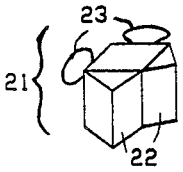

Referring to FIGS. 4A and B, other embodiments of the present invention comprise a head structure 19 having at least two convex cleaning substructures 20 or a head structure 21 having at least two wedge-shaped cleaning substructures 22. Preferred embodiments comprise a key cleaner having removable cleaning substructures positioned at right angles to each other on the head structure as depicted in FIGS. 4A and B. In a more preferred embodiment of the key cleaner, the first cleaning substructure is used for washing or scouring the keys and the second cleaning substructure is used for wiping or drying the keys. In this configuration the user may wash or scour the keys, flip the head structure to the second cleaning substructure and then wipe or dry the key surfaces of residual cleaning liquid. The washing or scouring substructure is advantageously comprised of an abrasive material and the wiping or drying substructure is advantageously comprised of an absorbent material. In especially preferred embodiments, the key cleaner advantageously includes two rigid handles 23. In this aspect of the invention, each handle is rigidly attached to the head structure at a side opposite a cleaning substructure and at a position on the head structure which allows the user to provide the necessary leverage required to wash or scour a key. The preferred position of the handle is that which will maximize the leverage placed on the cleaning sub-structure on the head structure, about 180 degrees away from the cleaning substructure to be used.

In a preferred embodiment of a key cleaner having two convex or wedge-shaped cleaning substructures, a first washing or scouring cleaning substructure, comprised of an absorbent material from which emanate semi-rigid brush-like protrusions from the absorbent material, is at right angles on the head structure from a second wiping or drying substructure which is comprised of absorbent material. Preferred embodiments of a key cleaner having two cleaning substructures also have two handles, as shown in FIGS. 4A and B. A first handle, which is preferably hollow, compressible and operatively connected to a conduit for delivering cleaning liquid to the surface of the first cleaning substructure, is positioned on the head structure on a side opposite, i.e., about 180 degrees, from the first cleaning substructure. The first handle is preferably integral with a flat support structure on the head structure. As in other embodiments of the present invention, the absorbent material of the first cleaning substructure is preferably of a character that allows cleaning liquid to migrate to its surface from an area in proximity to a conduit carrying cleaning liquid.

The second substructure is preferably positioned on the head structure at right angles to the first substructure. The second handle, which is rigid and integral with the head structure, is preferably positioned on the head structure on a side opposite, i.e., about 180 degrees from, the second substructure. The second substructure is preferably comprised of an absorbent material which is suitable for wiping or drying residual cleaning liquid that remains after a first washing or scouring step. Preferably, each of the cleaning substructures is easily replaceable and is secured to the head structure using any number of previously discussed devices available in the art.

Figure 5A:
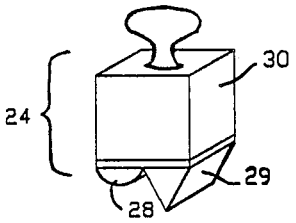
FIGS. 5A and 5B are perspective views showing the key cleaner having both a convex cleaning substructure and a wedge-shaped cleaning substructure.
Figure 5B:
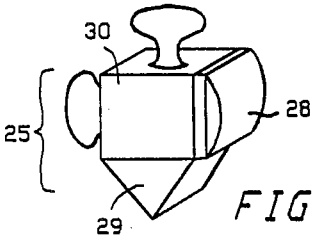

Referring to FIGS. 5A, B, C and D, another aspect of the key cleaner of the present invention comprises a head structure 24, 25, 26 and 27 having at least two different shaped cleaning substructures. It is contemplated that the key cleaner may have at least one convex-shaped cleaning substructure 28 and at least one wedge-shaped cleaning substructure 29, a configuration which is preferred. Other embodiments may comprise a head structure having at least one of the above cleaning substructures, and at least one concave-shaped cleaning substructure contoured to convex keys, for example, a space bar. Additional embodiments may comprise a head structure having all three types of cleaning substructures or alternatively, may have one or more cleaning substructures which conform to other special key shapes, for example the enter key, shift key, tab key and control keys, among others.

In the aspect of the present invention wherein at least two different shaped cleaning substructures are incorporated into the head structure, it is contemplated that the same materials used for other embodiments of the present invention will be used for the head structure, the handle or handles and the cleaning substructures. Thus, abrasive materials are preferably contemplated for the structures used for washing or scouring and absorbent material is contemplated for wiping or drying. Preferred embodiments utilize abrasive, brush-like protrusions which emanate, most preferably, from underlying sponge-like material. In embodiments utilizing a conduit for delivering cleaning fluid from the storage area to the cleaning surface, the underlying sponge-like materials function to aid the delivery of cleaning fluid to the surface of the cleaning substructure. In embodiments having no means for delivering cleaning liquid, combinations of abrasive, brush-like protrusions with underlying absorbent materials may be used to provide both washing or scouring and wiping or drying with one cleaning substructure.

Figure 5C:
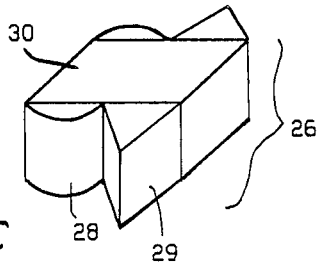
FIG. 5C is a perspective view showing the key cleaner having two convex substructures and two wedge-shaped substructures.
Figure 5D:
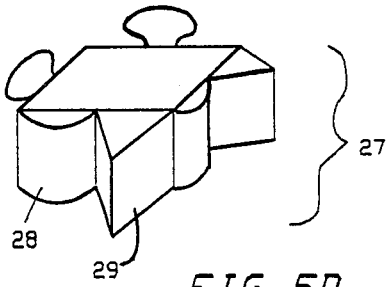
FIG. 5D is a perspective view of showing the key cleaner having two sets of different cleaning substructures at right angles to each other.

The handle is preferably made of plastic as is the flat support 30 of the head structure to which the cleaning substructure is preferably attached, as pictured in FIG. 5D. The handle may be positioned directly on the cleaning substructure or on the flat support on a side away from the cleaning substructure. In one especially preferred embodiment, a convex cleaning substructure and a wedge-shaped cleaning substructure are positioned side by side on the head structure as shown in FIGS. 5A, C and D. In this configuration, the cleaning substructures are advantageously designed to fit the contours of top surfaces of a single key and the lateral surfaces of adjacent keys. In certain preferred embodiments, the handle is comprised of excess material from which the cleaning substructures are made in whole or in part, or may simply comprise ridges or other indentations on the head structure (see FIG. 5C). In an embodiment according to FIG. 5C, the head structure functions as the storage unit for delivering cleaning fluid to the cleaning substructures designed to wash or scour the keys. Depending on the type of material used for the surface of the cleaning substructures, one cleaning substructure may be used to wash or scour and the other to wipe or dry both the top surface and side surface of the alphanumeric keys.

In another embodiment, as shown in FIG. 5D, the two sets of different cleaning substructures are at right angles to each other on the head structure. In such an embodiment, two handles may be integral with the flat support of the head structure, each handle positioned on the head opposite, i.e., at 180 degrees to, a set of cleaning substructures. Alternatively, in this configuration, it may be advantageous to have one handle which can be easily removed and attached to either of the two sides of the flat support, i.e., at the sides of the head structure opposite the cleaning substructure to be used. Thus, when one set of cleaning substructures is to be used, the handle may be attached to the side of the head structure opposite that cleaning substructure. Accordingly, when the other set of cleaning substructures is to be used, the handle may be removed and attached to the side of the flat support opposite that cleaning substructure.

Referring to FIGS. 6 A, B, C and D, an additional aspect of the key cleaner of the present invention comprises a head structure 31 having a plurality of cleaning substructures 32, 33 on the same side of the head structure, each cleaning substructure extending outwardly from the head structure along a single row. Thus, the head structure may be comprised of a row of convex or wedge-shaped cleaning substructures. Alternating cleaning substructures may be adapted for washing or scouring, or for wiping or drying the surfaces of the keys. By using an embodiment having alternate cleaning substructures, i.e., one substructure adapted for washing or scouring and one substructure adapted for wiping or drying, the two step process of washing and drying the surfaces of the keys may proceed much faster than when two separate key cleaners are used.

In preferred embodiments of the key cleaner having convex cleaning substructures in one row (FIG. 6A), the substructures will fit snugly into the top surfaces of a series of keys along a row. In an especially preferred embodiment, the distance between the centers of the surfaces of the cleaning substructures will be uniform.

In embodiments utilizing wedge-shaped cleaning substructures along a single row, the length L of each wedge-shaped cleaning substructure is preferably no greater than the length b of the base of the alphanumeric keys on the keyboard (refer to FIGS. 2B and C) and the distance between each cleaning substructure is such that each cleaning substructure will fit between adjacent keys on a data-entry keyboard. The distances are chosen to maximize the surface area of the keys that come in contact with the cleaning substructure.

In another embodiment having the wedge-shaped cleaning substructures, the length L of the wedge-shaped cleaning surfaces is greater than the base length b of an alphanumeric key. This embodiment is designed to clean the lateral surfaces of alphanumeric keys along a series of key rows simulteneously. In this embodiment the distance between each wedge-shaped cleaning substructure is uniform so that each cleaning substructure will fit between adjacent key rows on a data-entry keyboard. Each substructure should fit snugly into the space between the keys allowing maximal contact between the cleaning surfaces and the lateral surfaces of the keys. Because there are commonly only four or five rows of keys on a data-entry keyboard, it is preferred that the number of wedge-shaped cleaning substructures on a head structure in this embodiment should be no more than five and most preferably no more than three, each wedge-shaped cleaning substructure corresponding to the space between two adjacent rows of keys.

In addition, the keyboards tend to slant downward toward the user; the rows of keys on most computer keyboards also slant. It is therefore preferred that each cleaning substructure corresponding to a row of keys will slant or be contoured in such a way to maximize the surface area of the cleaning substructure that will come into contact with the sides of the keys. It is also preferred that the width w of the tapered end of the wedge-shaped cleaning substructure (refer to FIG. 2B) should be less than the distance d between any two adjacent alphanumeric keys on the keyboard. In preferred embodiments, this distance will be no greater than 1/32 of an inch. Abrasive and/or absorbent materials contemplated for the cleaning substructures are the same as for previously described embodiments.

Figure 6A:
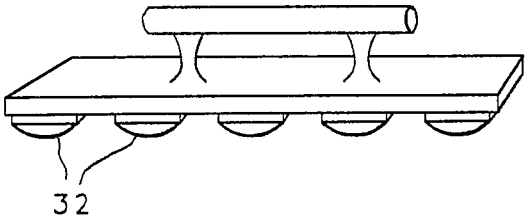
FIGS. 6A and 6B are perspective views showing the key cleaner having rows of convex or wedge-shaped cleaning substructures.
Figure 6B:
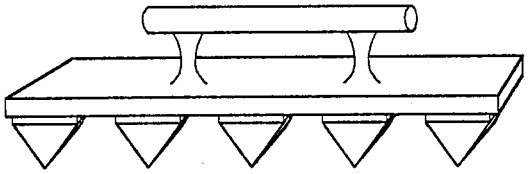
Figure 6C:
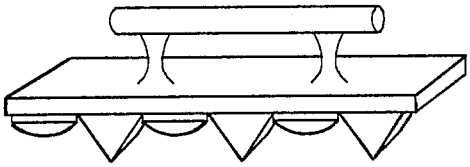
FIGS. 6C and 6D are perspective views showing the key cleaner having a single row of cleaning substructures alternately contoured to the top and lateral surfaces of the keys of a data-entry keyboard.

An additional embodiment of the present invention may comprise a key cleaner having a row of wedge-shaped cleaning substructures, as pictured in FIG. 6B, alternately adapted for scouring or drying. By alternating the types of cleaning substructures, it would be possible to perform a first washing or scouring step followed by a wiping or drying step much faster than using two separate key cleaners. The materials used for the cleaning substructures as well as for the handle, support structure where used, and for other structures including the means for vibrating or moving the cleaning substructures are the same for this embodiment as for the other embodiments.

Other embodiments of the key cleaner of the present invention are especially preferred. For example, referring to FIG. 6C, a particularly useful configuration of the present invention comprises alternating convex and wedge-shaped cleaning substructures along a single row. The cleaning substructures may be comprised of the same material, for example, either abrasive or absorbent, to provide a scouring or drying action along an entire row, or alternatively, the cleaning substructures may be comprised of abrasive or absorbent materials on alternating cleaning substructures or alternating groups of cleaning substructures.

Figure 6D:
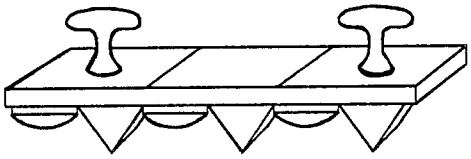

An additional embodiment may include abrasive and absorbent material on alternating sets of two cleaning substructures, as pictured in FIG. 6D. Such an embodiment may include means for delivering cleaning liquid to the abrasive cleaning substructures by adapting handles to store and deliver cleaning fluid as described for other embodiments of the present invention.

Figure 6E:
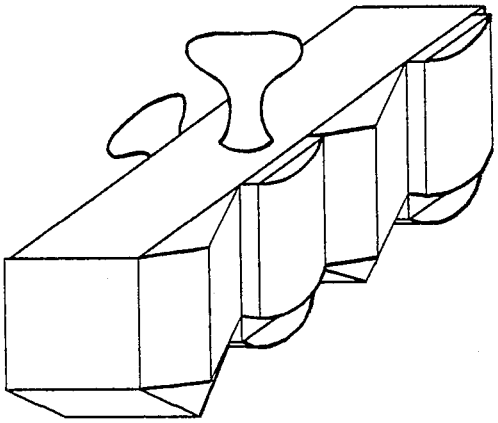
FIG. 6E is a perspective view showing the key cleaner having two rows of alternately contoured cleaning substructures.

Referring to FIG. 6E, another embodiment of the present invention includes two rows of cleaning substructures alternating between convex and wedge-shaped. It is preferred in this embodiment that the two rows of cleaning substructures are at right angles to each other on the head structure and are replaceable. It is preferred that each of two handles is on a side of the head structure opposite, i.e. about 180 degrees from, a cleaning substructure, as pictured in FIG. 6E. The handles are preferably integral with the head structure. In an especially preferred embodiment of the key cleaner according to FIG. 6E, all of the cleaning substructures along a first row are comprised of an abrasive material and all the cleaning substructures along a second row are comprised of an absorbent material. In this configuration, one row of cleaning substructures functions to wash or scour the keys and the other row of cleaning substructures functions to wipe or dry the keys. Using this embodiment, the user would be able to wash or scour the tops and sides of the keys, flip the cleaner over to the other row of cleaning substructures and in one simple motion, dry the keys that had been previously cleaned. In a modification of the foregoing embodiment, one of the handles and preferably, the handle opposite the row of substructures used to wash or scour the keys, is adapted to store a liquid and is provided with a conduit or other means for delivering a cleaning liquid to the surfaces of those substructures.

Figure 7:
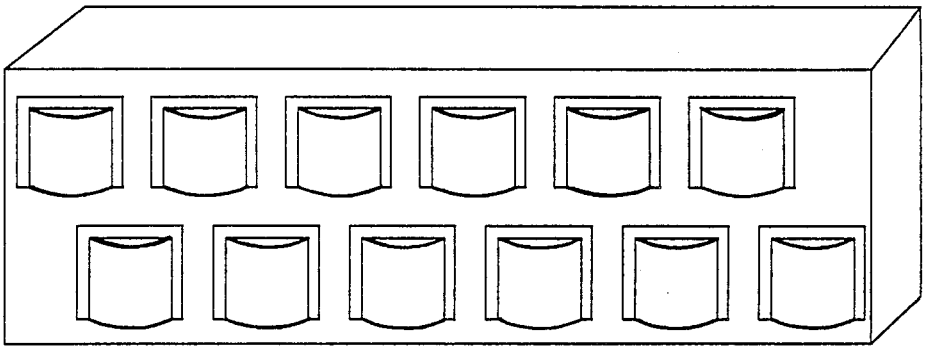
FIG. 7 is a bottom perspective view showing the key cleaner having multiple rows of cleaning substructures contoured to the upper surfaces of the keys of a data-entry keyboard.

Another preferred embodiment comprises a key cleaner having multiple rows of cleaning surfaces designed to snugly fit into a number of top key surfaces at one time, as depicted in FIG. 7. To maximize the surface area of the cleaning substructures that come into contact with the key surfaces, it is contemplated that the rows of cleaning substructures or the cleaning structures will slant according to the slant in the rows of keys on the keyboard. In addition, in this embodiment, because the key rows on most keyboards are staggered, the rows of cleaning substructures should also stagger to maximize the fit of the cleaning substructures onto the surfaces of the keys. It would also be possible to provide alternating rows of convex cleaning surfaces and wedge-shaped cleaning surfaces. Additional embodiments could utilize rows having alternating washing or scouring and wiping or drying structures. All of these embodiments as well as equivalents of these embodiments are, of course, contemplated by the invention of the present application.

The method aspect of the present invention for cleaning keys on a data entry keyboard comprises the step of contacting the surface of the keys of a data entry or similar keyboard with any one of the above described keys cleaners to remove dirt or grease on the keys.

Another aspect of the method of the present invention includes a first step in which cleaning fluid is first delivered to the top and/or lateral surfaces of the keys or to the surface of the cleaning substructure of the key cleaner either by a means for delivering the cleaning liquid which has or has not been included with the key cleaner. This step may be combined with a washing or scouring step, which in turn may be followed by a wiping or drying step. An additional aspect of the method of the present invention includes the step of wiping or drying the surface of the keys with a key cleaner, preferably with one having a cleaning substructure comprised of an absorbent material.

This invention has been described in terms of specific embodiments set forth in detail herein, but it should be understood that these are by way of illustration and the invention is not necessarily limited thereto. Modifications and variations will be apparent from the disclosure and may be resorted to without departing from the spirit of the invention as those of skill in the art will readily understand. Accordingly, such variations and modifications are considered to be within the purview and scope of the invention and the following claims.

I claim:

1. A device for cleaning the keys of a data-entry type keyboard, comprising:

a head structure having a plurality of cleaning substructures extending outwardly from said head structure along a single row, said substructures including a plurality of first cleaning substructures having a common first shape and at least one second cleaning substructure having a second shape geometrically different from said first shape, said second cleaning substructure being disposed between said first cleaning substructures along said row; and means attached to said head structure for facilitating a gripping of the device.

2. The device according to claim 1 wherein one of said first shape and said second shape is a wedge shape and the other of said first shape and said second shape is convex.

3. The device according to claim 1 wherein said plurality of cleaning substructures includes a plurality of cleaning substructures having said second shape alternating along said row with said plurality of first cleaning substructures having said first shape.

4. The device according to claim 3 wherein said plurality of cleaning substructures are all comprised of the same material.

5. The device according to claim 4 wherein said material is abrasive.

6. The device according to claim 4 wherein said material is absorbent.

7. The device according to claim 1 wherein said plurality of cleaning substructures are comprised of abrasive and absorbent materials on alternating groups of cleaning substructures.

8. A device for cleaning the keys of a data-entry type keyboard, comprising:

a head structure having a plurality of cleaning substructures extending outwardly from said head structure along a single row, said substructures including a plurality of first cleaning substructures having a common first shape and at least one second cleaning substructure having a second shape geometrically different from said first shape, said second cleaning substructure being disposed between said first cleaning substructures along said row, one of said first shape and said second shape being a wedge shape and the other of said first shape and said second shape being convex; and means attached to said head structure for facilitating a gripping of the device.

9. The device according to claim 8 wherein said first shape is convex.

10. The device according to claim 8 wherein said first shape is a wedge shape.

11. The device according to claim 8 wherein said plurality of cleaning substructures includes a plurality of convex cleaning substructures alternating along said row with a plurality of wedge-shaped cleaning substructures.

12. The device according to claim 11 wherein said convex cleaning substructures and said wedge-shaped cleaning substructures are all comprised of the same material.

13. The device according to claim 12 wherein said material is abrasive.

14. The device according to claim 12 wherein said material is absorbent.

15. The device according to claim 8 wherein said plurality of cleaning substructures are comprised of abrasive and absorbent materials on alternating groups of cleaning substructures.

* * * * *